United States Patent [19]

Hihara et al.

[11] Patent Number: 4,932,786

[45] Date of Patent: Jun. 12, 1990

[54] BUBBLE GENERATOR FOR CELLULAR CONCRETE

[75] Inventors: Mikio Hihara; Nobuhisa Suzuki, both of Fuji, Japan

[73] Assignee: Nissei Plan, Inc., Japan

[21] Appl. No.: 234,949

[22] Filed: Aug. 22, 1988

[51] Int. Cl.[5] ..... B01F 13/02

[52] U.S. Cl. ..... 366/101; 366/338; 366/341; 261/DIG. 26

[58] Field of Search ..... 366/336, 338, 101, 341, 366/198; 138/38, 42; 261/DIG. 26

[56] References Cited

U.S. PATENT DOCUMENTS

| | | | |
|---|---|---|---|
| 2,583,206 | 1/1952 | Borck et al. | 366/338 |
| 2,864,714 | 12/1958 | Dixon, Jr. et al. | 261/DIG. 26 |
| 2,894,732 | 7/1959 | Taber et al. | 366/336 X |
| 3,554,496 | 1/1971 | Nusstein | 366/338 |
| 4,038,037 | 7/1977 | Wilmsen, deceased | 261/DIG. 26 X |
| 4,204,775 | 5/1980 | Speer | 366/336 |
| 4,299,925 | 11/1981 | Ogden | 261/DIG. 26 |

*Primary Examiner*—Frankie L. Stinson

*Attorney, Agent, or Firm*—Wenderoth, Lind & Ponack

[57] ABSTRACT

A bubble generator for producing cellular concrete which comprises an interchangeable housing containing a plurality of particles. The housing is releasably connected to a first and second retaining means at its respective first and second ends for retaining the particles in the housing. The particles contained in the housing can be the same or different in size, substantially spherical or nodular in shape, and about 100 to 6000 in number. The device generates uniform and strong bubbles of frother solution for cellular concrete.

11 Claims, 2 Drawing Sheets

BUBBLE GENERATOR FOR CELLULAR CONCRETE

BACKGROUND OF THE INVENTION

Figure 1:
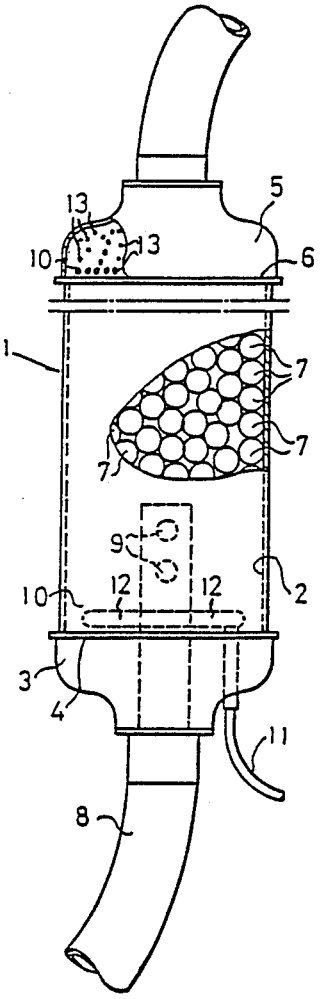

The present invention relates to a bubble generator for producing cellular concrete. More particularly the present invention relates to a bubble generator having particles in its housing main body, the uniformity of bubbles of frother solution for producing cellular concrete is improved by the use of such generator.

The light weight, heat insulation, fire resistance, and sound insulation of cellular concrete manufacture have allowed it to find a definite niche in the field of building material.

The process of producing cellular concrete manufacture is generally divided into two: (1) to make a cement paste foam in a form after mixing all the ingredients and (2) to mix a cement mortar with a bubbled frother solution, followed by casting this cellular concrete paste into a form. The latter method is widely used since it can make it easy to manufacture the desired form of cellular concrete. However, this process has a difficulty of controlling the flow of aerated concrete slurry or causing defoaming during the mixing.

It is well known that the mechanical strength of cellular concrete manufacture depend greatly upon the uniformity of bubbles formed in the frother solution. The conventional bubble generator, however, is not entirely satisfactory in generating uniform and strong bubbles of frother solution.

For this reason, surface active agents or decomposition products of keratin-type proteins are commonly used as frother. And also, Japanese Patent Publication No. 61-5673 provides process in which cellular concrete is produced by addition of anionic surface active agents during or just after mixing a cement mortar with a bubbled, high-viscous frother solution. The use of thickeners in the frother solution is also proposed.

However, the use of such additives as frother has not made the mechanical strength of cellular concrete manufacture sufficiently higher.

SUMMARY OF THE INVENTION

In accordance with the present invention, a bubble generator containing particles in its housing main body is provided that generates uniform and strong bubbles of frother solution for cellular concrete.

The bubble generator of the invention consists mainly of a housing main body which contains particles in it and is interchangeable depending upon the contents of bubbles to be required, the particles which are similar or different in form or size; an inlet and outlet for frother solution; and an air nozzle.

The excellent ability of the bubble generator of the invention enables a frother solution containing no surface active agents to foam sufficiently. For example, a frother solution containing only polycarboxylic acid and alkylene glycol can be bubbled well by the use of the bubble generator of the invention.

Since the bubble generator of the invention is so designed that the housing main body can be interchanged, it is easy to adjust the content of blowholes in cellular concrete to requirements, by changing the length of the housing main body. And also, the structure of the bubble generator of the invention is so simple that the inside of the body is easily cleaned, resulting in lowering the cost of maintenance.

The following Examples are illustrative and represent preferred embodiments of a bubble generator of the invention.

FIG. 1 illustrates a schematic drawing of the bubble generator of the invention.

Figure 2:
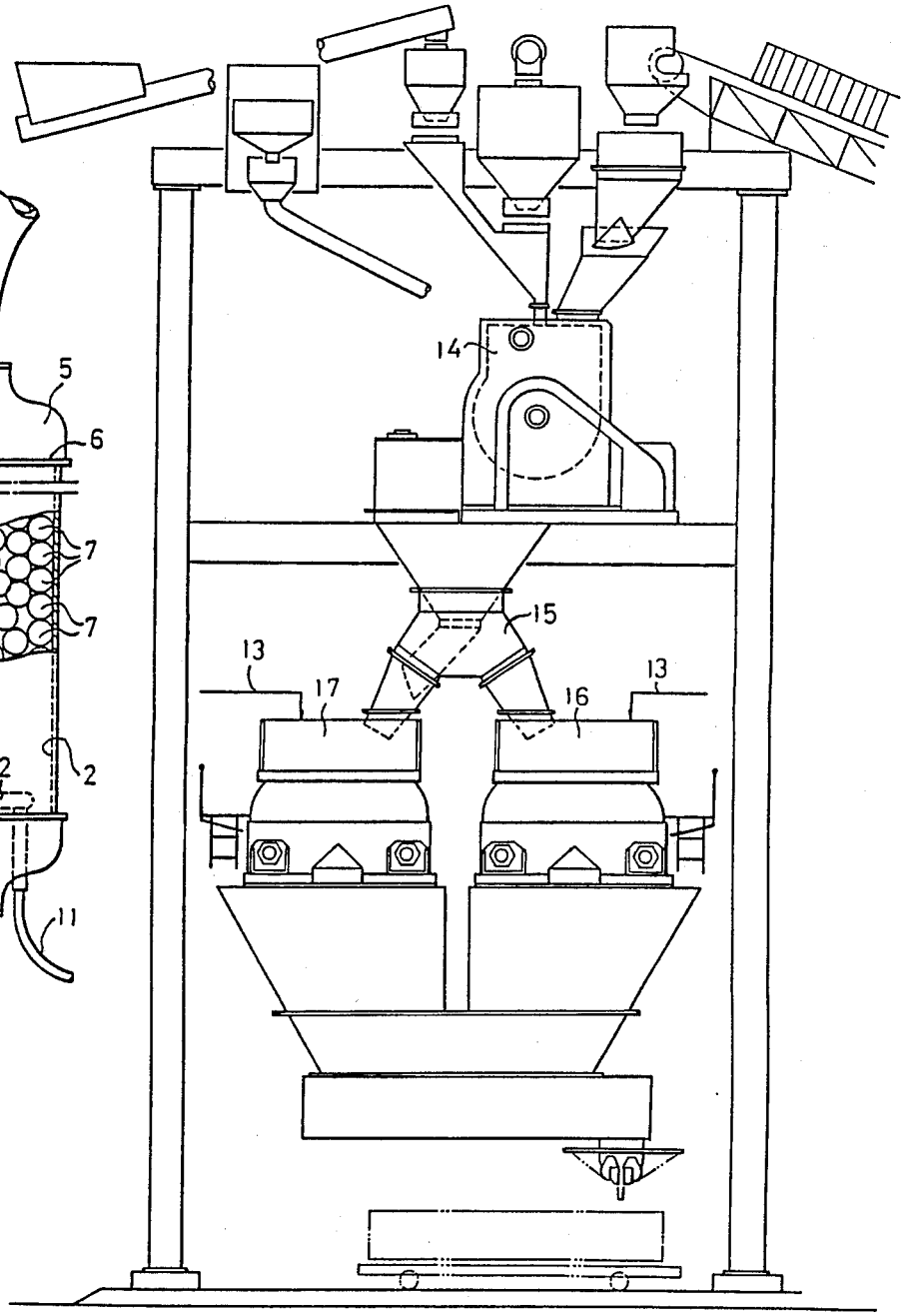

FIG. 2 gives a drawing of a mixer unit used for the preparation of cellular concrete manufacture to be tested.

The drawing presented in FIG. 1 represents preferred embodiments of the bubble generator of the invention. The reference number 1 designates a housing main body having a hollow wall 2 inside the body, which is cylindrical or can-type in shape and set vertically; 3 a retaining component having a closing plate 4, which can be freely released from the housing main body 1; 5 a component of controlling bubbles having a screen 6, which can be freely released from the housing main body 1; 6 a screen having holes, which is in the form of net; 7 particles, the number of which is about 6000, whose shape are nearly spherical or nodular and whose size are the same or different from each other; 8 a component of feeding a frother solution, which is inserted perpendicularly through the closing plate 4 into the housing main body 1 and has a nozzle 9 of supplying a frother solution 10; 11 a tube for compressed air; 12 a nozzle of supplying air into the housing main body 1; and 13 bubbles which have been formed in the bubble generator of the invention.

Within the bubble generator of the invention, the frother solution is first mixed with the air to form a number of bubbles. At this stage, the bubbles are not considered to be uniform and to have strong membranes. The bubbles will be refined by passing through the clearance between the particles in the main body. The bubbles are then unified by passing through the screen 6, resulting in a frother solution containing uniform and strong bubbles.

The particles in the main body are usually similar to one another in shape and size; as an example, glass balls can be used. The particles can also be so arranged that the larger ones in size are places in the lower part of the main body and the smaller in the upper; this causes the clearance to narrow as the bubbles are coming up, leading to further uniformity.

EXAMPLE 1

Cellular concrete manufactures were prepared using a prior art bubble generator or a bubble generator of the invention shown in FIG. 1, with a frother solution containing a surface active agent or mixture of maleic acid and ethylene glycol. A mixer unit shown in FIG. 2 was used for the preparation of cellular concrete manufactures to be tested.

Into the mixer 14 were placed 360 kg of Portland cement (Nippon Cement) and 200 kg of water. The mixture was blended for 2 minutes and transferred through the connection 15 into the mixer 16. In the meantime, a frother solution (1.0 kg of Frother shown in Table 1 in 19 kg of water) which had been aerated by a bubble generator, shown in Table 1, was fed into the mixer 16. The mixture was blended for 5 minutes and casted into a form. The cellular concrete in the form was allowed to stand for 28 days at room temperature and taken out. The used test plates were in the form of $4\times4\times16$ cm$^3$.

The procedures and results are given in Table 1 and 2, respectively.

TABLE 1

| Example No. | Bubble Generator | Frother |
|---|---|---|
| Control | Prior art (A gear-type: White Mann Co., U.S.A.) | Foamix C: Hamano Kogyo (a sulfate of higher alcohol) |
| Example 1 | Invention shown in FIG. 1 | Foamix C: Hamano Kogyo (a sulfate of higher alcohol) |
| Example 2 | Invention shown in FIG. 1 | maleic acid and fumaric acid and ethylene glycol (4:4:2 by weight) |

TABLE 2

| Example No. | Specific Gravity | Flexural Strength ($kg/cm^2$) |
|---|---|---|
| Control | 0.58 | 2.3 |
| Example 1 | 0.58 | 3.1 |
| Example 2 | 0.58 | 4.2 |

The improvement when using the bubble generator of the invention as compared with the Control is evident from the above data.

Since many embodiments of the invention may be made without departing from the spirit and scope thereof, it is to be understood that the invention is not limited by the specific examples except to the extent defined in the following claims.

What is claimed is:

1. A bubble generator for producing cellular concrete, comprising:

an interchangeable housing having first and second ends for passing a frother solution therethrough;

a plurality of particles contained in said interchangeable housing for generating bubbles in the frother solution when the frother solution is passed through said interchangeable housing from said first end to said second end of said housing and around said plurality of particles;

a first retaining means releasably connected to said first end of said interchangeable housing, said first retaining means including a closing plate for retaining said particles in said interchangeable housing;

a frother inlet nozzle in said first retaining means for delivering the frother solution into said interchangeable housing;

a compressed air inlet nozzle in said first retaining means for delivering compressed air into said interchangeable housing;

a second retaining means releasably connected to said second end of said interchangeable housing, said second retaining means including a screen having a plurality of holes for passing the frother solution containing bubbles therethrough and for refining the bubbles contained in said frother solution, thereby obtaining a frother solution containing bubbles of substantially uniform size and strength; and a frother outlet in said second retaining means for discharging the frother solution containing bubbles of substantially uniform size and strength.

2. A bubble generator according to claim 1 in which the housing has a hollow wall.

3. A bubble generator according to claim 1 in which the shape of the housing is cylindrical or can-type.

4. A bubble generator according to claim 1 in which the housing is positioned vertically.

5. A bubble generator according to claim 1 in which the size and shape of the particles are similar to one another.

6. A bubble generator according to claim 1 in which the shape of the particles are substantially spherical or nodular.

7. A bubble generator according to claim 1 in which the number of the particles is more than 100.

8. A bubble generator according to claim 1 in which the number of the particles is about 6000.

9. A bubble generator according to claim 1 in which the particles are different in size from each other.

10. A bubble generator according to claim 9 in which the larger ones are placed in the lower part of the body and the smaller in the upper.

11. A bubble generator according to claim 9, in which larger particles are disposed near said first end of said housing and smaller particles are disposed near said second end of said housing.

* * * * *